US007489893B2

(12) United States Patent
Teraoka et al.

(10) Patent No.: US 7,489,893 B2
(45) Date of Patent: Feb. 10, 2009

(54) HYBRID TYPE DEVELOPING APPARATUS AND DEVELOPING METHOD

(75) Inventors: Tsutomu Teraoka, Seongnam-si (KR); Masahiko Itaya, Suwon-si (KR); Kyu-cheol Shin, Seoul (KR); Tsutomu Sasaki, Suwon-si (KR); Myung-kook Ahn, Suwon-si (KR); Naonori Kurogawa, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/441,054

(22) Filed: May 26, 2006

(65) Prior Publication Data

US 2007/0019995 A1 Jan. 25, 2007

(30) Foreign Application Priority Data

Jul. 20, 2005 (KR) ..... 10-2005-0065699

(51) Int. Cl.
*G03G 15/08* (2006.01)
*G03G 15/09* (2006.01)

(52) U.S. Cl. ..... 399/266; 399/282; 399/285; 399/291

(58) Field of Classification Search ..... 399/53, 399/55, 265, 266, 267, 270, 272, 274, 281, 399/282, 283, 285; 430/120.1, 122.1
See application file for complete search history.

(56) References Cited

U.S. PATENT DOCUMENTS

| | | | | |
|---|---|---|---|---|
| 5,206,693 | A | 4/1993 | Folkins | |
| 5,245,392 | A * | 9/1993 | Behe et al. | 399/266 |
| 5,337,124 | A * | 8/1994 | Schmidlin et al. | 399/282 |
| 5,420,375 | A * | 5/1995 | Folkins et al. | 399/270 |
| 5,523,826 | A * | 6/1996 | Jugle | 399/283 X |
| 5,592,271 | A * | 1/1997 | Parker et al. | 399/285 |
| 5,594,534 | A * | 1/1997 | Genovese | 399/285 |
| 5,940,667 | A | 8/1999 | Folkins | |
| 6,246,855 | B1 * | 6/2001 | Gartstein et al. | 399/281 |
| 6,895,202 | B2 | 5/2005 | LeStrange et al. | |
| 2005/0063737 | A1 * | 3/2005 | LeStrange et al. | 399/266 |

FOREIGN PATENT DOCUMENTS

| | | |
|---|---|---|
| JP | 06-067546 | 3/1994 |

(Continued)

*Primary Examiner*—Sophia S Chen
(74) *Attorney, Agent, or Firm*—Roylance, Abrams, Berdo & Goodman, L.L.P.

(57) ABSTRACT

A hybrid type developing apparatus and method forms a magnetic brush of non-magnetic toner and a magnetic carrier on a circumference of a magnetic roller forms a uniform toner layer on the circumference of a donor roller using only toner from the magnetic roller, and develops an electrostatic latent image on an image receptor. The hybrid type developing apparatus includes: a plurality of electrodes on the circumference of the donor roller; first and second brush electrodes in an upstream area and a downstream area, respectively, of the donor roller facing the magnetic roller with respect to a direction of rotation; and a bias applying device for applying a recovery bias to the first brush electrode to remove toner from the donor roller and a supply bias to the second brush electrode to supply toner from the magnetic roller to the donor roller.

11 Claims, 4 Drawing Sheets

FOREIGN PATENT DOCUMENTS

| | | |
|---|---|---|
| JP | 06-324561 | 11/1994 |
| JP | 07-072733 | 3/1995 |
| JP | 07-092804 | 4/1995 |
| JP | 2000-250294 | 9/2000 |
| JP | 2003-057863 | 2/2003 |

* cited by examiner

HYBRID TYPE DEVELOPING APPARATUS AND DEVELOPING METHOD

CROSS-REFERENCE TO RELATED PATENT APPLICATION

This application claims the benefit of Korean Patent Application No. 10-2005-0065699, filed on Jul. 20, 2005, in the Korean Intellectual Property Office, the disclosure of which is hereby incorporated by reference in its entirety.

BACKGROUND OF THE INVENTION

1. Field of the Invention

The present invention relates to an electro-photographic type developing apparatus and method. More particularly, the invention relates to a hybrid type developing apparatus and method which uses a magnetic carrier and a nonmagnetic toner.

2. Description of the Related Art

Developing methods for image forming apparatuses are known using electro-photography such as copying machines, printers, facsimiles and multi-function apparatuses. One method is a dual component developing method using a toner and a carrier. A mono component developing method uses an insulation toner or a conductive toner. A hybrid developing method uses nonmagnetic toner that is charged by rubbing with magnetic carrier, and only charged toner is attached onto a development roller. In each method, the toner is supplied to an electrostatic latent image, thereby developing the electrostatic latent image.

The dual component developing method has advantages of excellent charging of the toner, durability, realization of uniform beta images, and so on. However, the dual component developing method requires a bigger and more complicated apparatus, scattering of the toner to allow a carrier to attach to a latent image, which results in image-quality deterioration due to a lack of durability of the carrier, and so forth.

The mono component developing method is advantageous since a compact developing apparatus can be used and excellent dot reproduction can be obtained. This method has the disadvantages of lower durability due to the deterioration of a development roller and a charging roller, higher costs due to the need to exchange the developing apparatus itself when toner is exhausted, occurrence of selective development, and so on. Selective development occurs when only the toner having a desired weight and charge is moved to the latent images from the developing roller. If the selective development occurs, because toner having a lower weight than the desired weight and a smaller charge than the desired charge can not be used for development, usage ratio may decrease.

The hybrid developing method has advantages of excellent dot reproduction, durability, and high speed image formation. However, development ghosts occur if the toner supplied to the development roller is insufficient or toner on the development roller is not fully removed after development. The occurrence of development ghosts will now be briefly explained with reference to FIG. 1. Referring to FIG. 1, a toner layer formed on the surface of the development roller has an area Ai facing an image portion of an image receptor which is developed on the image receptor by a development bias. An area Ab facing a non-image portion remains on the development roller without being developed. At this time, the amount of toner developed from the area Ai on the image receptor is denoted as Ma. New toner is supplied to the development roller for subsequent development. If the amount of toner supplied to the development roller is less than Ma, the thickness of the toner layer formed on the surface of the development roller becomes non-uniform, and a development ghost in which a latent image of an earlier development process remains in a subsequent development process occurs. Such a development ghost more easily occurs in continuous printing.

To solve these problems, a DC bias (Japanese Unexamined Patent Application Publication No. 7-72733) superposed on a DC bias or an AC bias (Japanese Unexamined Patent Application Publication Nos. 6-67546 and 7-92804) is applied to a magnetic roller. The polarity of the DC bias applied to the magnetic roller is switched when image formation is complete at regular intervals to provide an electric field in a proper direction for recovering toner from the development roller to the magnetic roller. Since a lot of time is required to form a toner layer having proper thickness on the development roller in subsequent development, such a method is unsuitable for high speed printing.

When an electrode is installed between the development roller and a photo conductor, a non-uniform development arises due to vibration of a wire tighten by an electrical bias or stripe traces are formed on the development roller due to dust instantly attached to the electrode. An example of a development roller in which an electrode is covered so as to prevent such phenomena is disclosed in Japanese Unexamined Patent Application Publication No. 2000-250294.

SUMMARY OF THE INVENTION

The present invention provides a hybrid type developing apparatus and method for reducing the occurrence of a development ghost. The invention also prevents non-uniform images from occurring during continuous printing, and produces a high image quality for a long time.

According to an aspect of the present invention, a hybrid type developing apparatus is provided which forms a magnetic brush comprised of non-magnetic toner and a magnetic carrier on a circumference of a magnetic roller using a magnetic force, forms a uniform toner layer on the circumference of a roller by providing only toner from the magnetic roller to the donor roller, and develops an electrostatic latent image on an image receptor with the toner on the donor roller. The hybrid type developing apparatus comprises: a plurality of electrodes arrayed on the circumference of the donor roller; first and second brush electrodes located in an upstream area and a downstream area, respectively, of an area of the donor roller facing the magnetic roller, contacting some of the electrodes, wherein the upstream area and the downstream area are an upstream and a downstream area with respect to the direction of rotation of the donor roller; and a bias applying device for applying a recovery bias to the first brush electrode to remove toner from the donor roller and a supply bias to the second brush electrode to supply toner from the magnetic roller to the donor roller.

The hybrid type developing apparatus may further comprise a third brush electrode that is disposed in a development area of the donor roller facing an image receptor and contacts some of the plurality of electrodes, where the bias applying device applies a developing bias to the third brush electrode so as to develop toner from the donor roller to the image receptor.

The hybrid type developing apparatus may further comprise a resin layer on the circumference of the donor roller wherein the plurality of electrodes are exposed outside of the resin layer at both ends of the donor roller so that the brush electrodes can contact the exposed portions of the electrodes.

According to another aspect of the present invention, there is provided a hybrid type developing method comprising: forming a magnetic brush from non-magnetic toner and a magnetic carrier on the circumference of a magnetic roller using a magnetic force; forming a uniform toner layer on the circumference of a donor roller by providing only toner from the magnetic roller to the donor roller; developing an electrostatic latent image formed on an image receptor with the toner on the donor roller; dividing an area of the donor roller facing the magnetic roller into an upstream area and a downstream area using a rotation direction of the donor roller as a reference direction; applying an electric field to the upstream area of the donor roller to remove toner from the upstream area; and applying an electric field to the downstream area of the donor roller to supply toner from the magnetic roller to the downstream area. An electric field for developing the toner from the donor roller onto the image receptor may be applied to a development area of the donor roller facing the image receptor, and the electric fields applied to the upstream area and the downstream area may be independent from the electric field applied to the development area.

A plurality of electrodes may be provided on the circumference of the donor roller, first, second, and third brush electrodes may be respectively formed in the upstream area, the downstream area, and the development area to contact some of the plurality of electrodes, and a recovery bias, a supply bias, and a development bias may be respectively applied to the first, second, and third brush electrodes to form the electric field for supplying toner, the electric field for removing the toner, and the electric field for developing the toner.

According to an aspect, if potentials of the DC components of a magnetic roller bias applied to the magnetic roller, the recovery bias and the supply bias are denoted as $V_m$, $V_r$ and $V_s$, respectively, when the toner is negatively charged, $V_r<V_m<V_s$, and when the toner is positively charged, $V_s<V_m<V_r$.

The electric potentials of the toner recovery area of the donor roller and the magnetic roller may be equal to each other and the magnetic brush may contact the surface of the donor roller so as to remove the toner from the donor roller.

According to another aspect of the present invention, there is provided a hybrid type developing method comprising: forming a magnetic brush from a non-magnetic toner and a magnetic carrier on the circumference of a magnetic roller using a magnetic force; forming a uniform toner layer on the circumference of a donor roller by providing only toner from the magnetic roller to the donor roller; developing an electrostatic latent image formed on an image receptor with the toner on the donor roller; dividing the circumference of the donor roller into a plurality of areas; and applying a separate bias to each of the areas.

These and other aspects of the invention will become apparent from the following detailed description of the invention which in conjunction with the annexed drawings disclose various embodiments of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

While the present invention has been shown and described with reference to exemplary embodiments thereof, it will be understood by those of ordinary skill in the art that various changes in form and details may be made therein without departing from the spirit and scope of the present invention as defined by the following claims.

Figure 2:
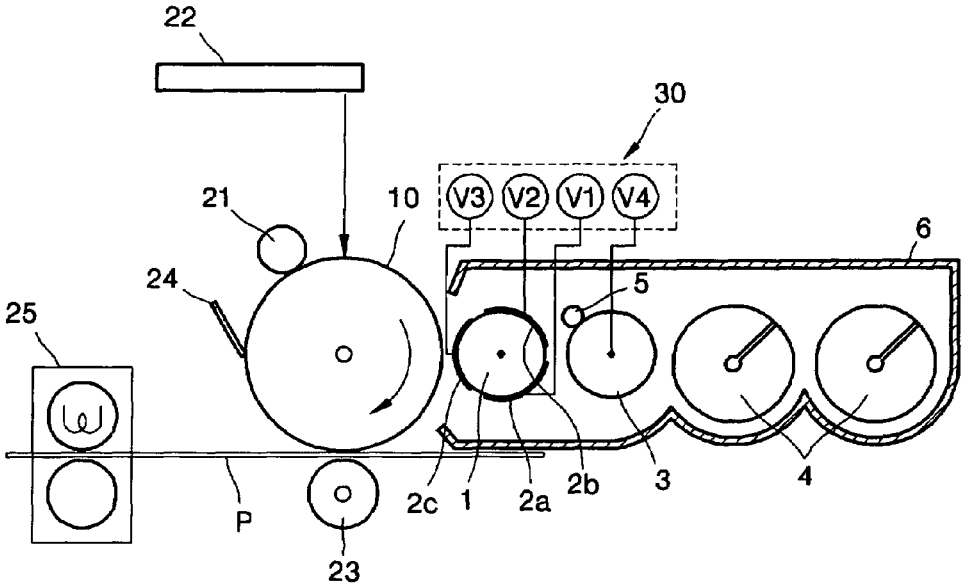
FIG. 2 is a schematic diagram of a hybrid type developing apparatus according to an embodiment of the present invention.

FIG. 2 is a schematic diagram of a hybrid type developing apparatus according to an embodiment of the present invention. Referring to FIG. 2, the hybrid type developing apparatus for printing images on a recording medium P includes an image receptor 10, a donor roller 1, and a magnetic roller 3. The hybrid type developing apparatus includes a transfer roller 23, a cleaning blade 24 and a fusing device 25. In the present embodiment, an organic photo conductor is employed as the image receptor 10. Alternatively, an amorphous silicon photo conductor may be employed as the image receptor 10. A charging device 21 and an exposure device 22 form an electrostatic latent image on the image receptor 10. A corona discharge device or a charging roller may be employed as the charging device 21. A laser scanning unit (LSU) radiating a laser beam may be employed as the exposure device 22. Further, an electrostatic drum may be employed as the image receptor 10. In such case, an electrostatic recording head (not shown) may be employed instead of the exposure device 22 to form an electrostatic latent image.

Non-magnetic toner and a magnetic carrier are stored in a developing device 6. The carrier is not limited except that a magnetic powder may be used. An agitator 4 agitates the carrier and the toner so as to electrically charge the toner through friction. The toner is not particularly limited and may be negatively or positively charged. The carrier is attached to the circumference of the magnetic roller 3 through a magnetic force produced by the magnetic roller 3, and the toner is attached to the carrier through an electrostatic force. As a result, a magnetic brush comprised of the carrier and the toner is formed on the circumference of the magnetic roller 3. A trimmer 5 controls the thickness of the magnetic brush. The gap between the trimmer 5 and the magnetic roller 3 ranges from 0.3 to 1.5 mm.

The donor roller 1 is positioned between the image receptor 10 and the magnetic roller 3. A development gap G between the donor roller 1 and the image receptor 10 ranges from 150 to 400 μm, and may range from 200 to 300 μm. If the development gap G is narrower than 150 μm, background fog occurs. On the other hand, if the development gap G is broader than 400 μm, because it is hard to transfer the toner to the image receptor 10, sufficient image density can not be obtained, which results in selective development. A gap between the magnetic roller 3 and the donor roller 1 is ranges from about 0.3 to about 1.5 mm.

Figure 3:
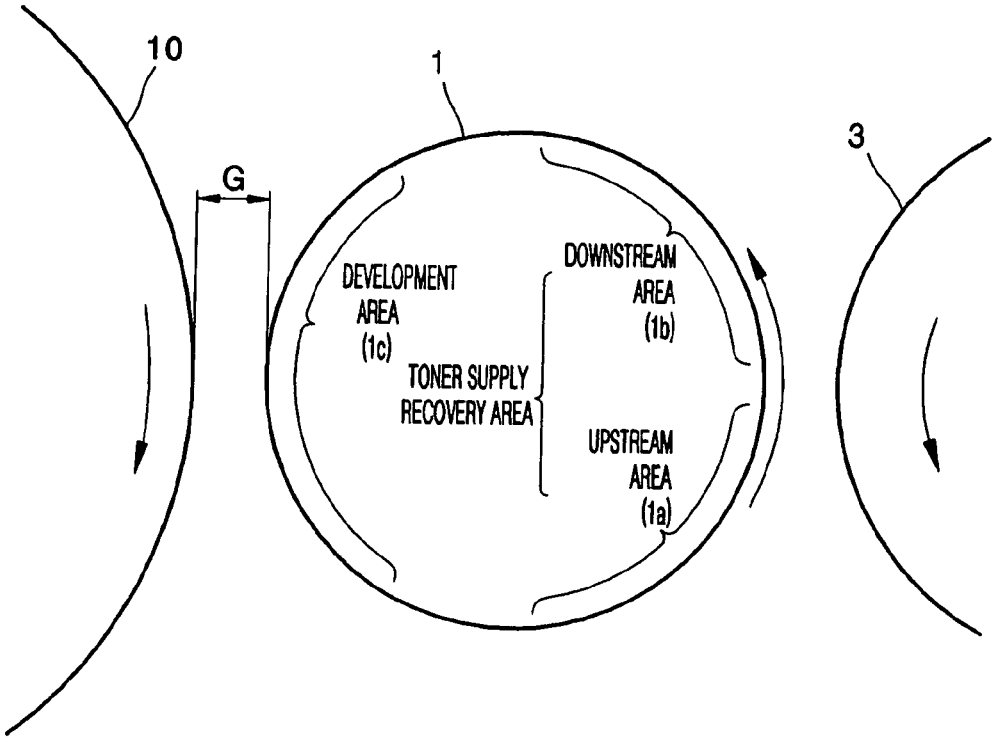
FIG. 3 is a schematic diagram of a development area, an upstream area, and a downstream area of a donor roller of the hybrid type developing apparatus illustrated in FIG. 2.

A developing method according to an embodiment of the present invention is characterized by dividing the circumference of the donor roller 1 into a plurality of areas and then applying an independent electric field to each of the areas. In particular, as shown in FIG. 3, the area (toner supply recovery area) of the donor roller 1 facing the magnetic roller 3 is divided into an upstream area 1*a* and a downstream area 1*b*, which are upstream and downstream with respect to the direction of rotation of the donor roller 1. The upstream area and downstream area of the donor roller are defined with respect to the closest point between the donor roller 1 and the magnetic roller 3. An electric field for supplying toner from the magnetic roller 3 to the donor roller 1 and an electric field for removing toner from the donor roller 1 are independently applied to the downstream area 1*b* and the upstream area 1*a*, respectively. These electric fields are independent of an electric field applied a development area 1*c* of the donor roller 1 in the region facing the image receptor 10.

Figure 4:
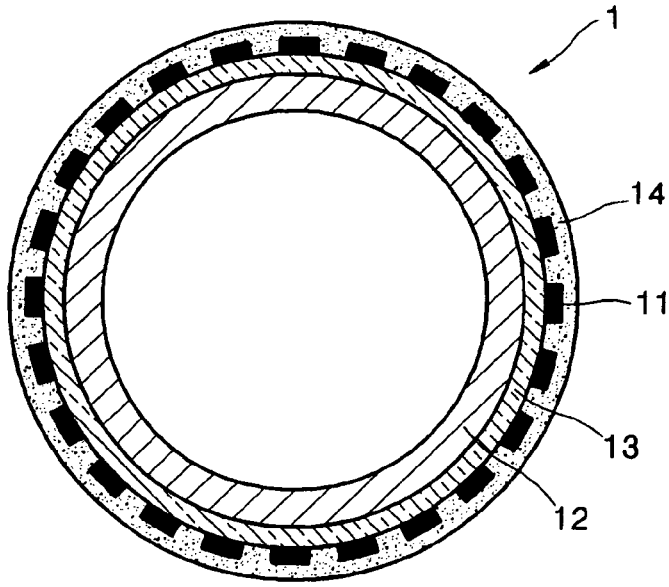
FIG. 4 is a cross sectional view of the donor roller illustrated in FIG. 3.
Figure 5:
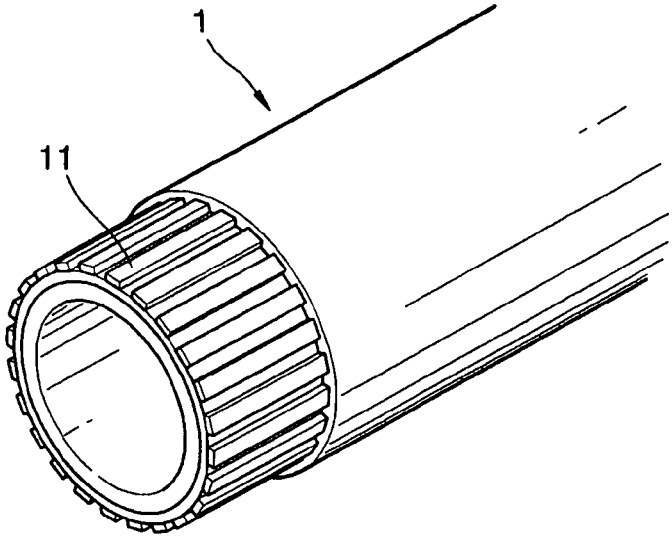
FIG. 5 is perspective view of an end of the donor roller illustrated in FIG. 3.

As shown in FIG. 4, a plurality of electrodes 11 are provided on the donor roller 1. The electrodes are spaced apart around the circumference of the roller and extend the length of the donor roller as shown in FIG. 5. A supporting body 12 formed of aluminum or stainless steel has a cylindrical shape to define a sleeve. An insulation layer 13 is provided between the supporting body 12 and the electrodes 11 in order to insulate the electrodes 11 from the supporting body 12. A resin layer 14 having volume resistivity of $10^6$ $\Omega\cdot cm^3$ or less is provided on the circumference of the donor roller 1. As shown in FIG. 5, the electrodes 11 are exposed to the outside of the resin layer 14 at both ends of the donor roller 1.

Figure 1:
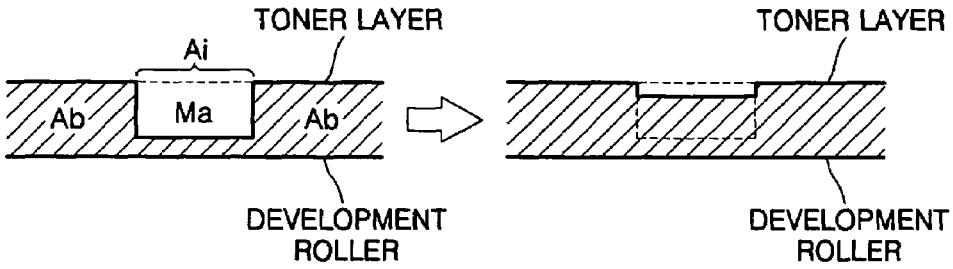
FIG. 1 is a diagram illustrating the process of forming a development ghost.
Figure 6:
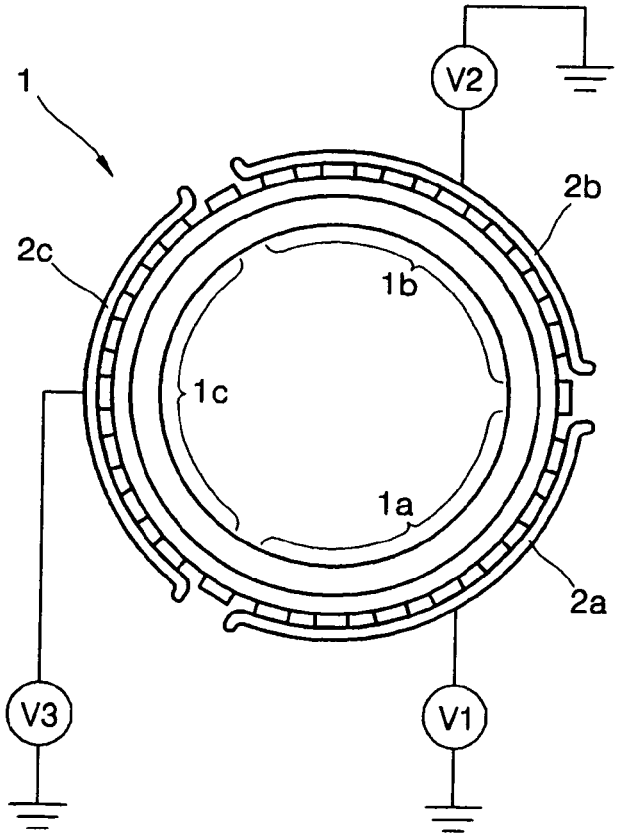
FIG. 6 is a cross-sectional view illustrating an arrangement of brush electrodes on the donor roller illustrated in FIG. 3 and arrangement of brush electrodes.

As shown in FIG. 6, first, second, and third brush electrodes 2*a*, 2*b*, and 2*c* are respectively positioned on the upstream area 1*a*, the downstream area 1*b*, and the development area 1*c* so as to apply separate electric fields thereto, and contact the exposed positions of the electrodes 11 at both ends of the donor roller 1. A bias applying device 30 shown in FIG. 1, respectively, applies a recovery bias V1, a supply bias V2, and a development bias V3 to the first, second, and third brush electrodes 2*a*, 2*b*, and 2*c*.

A magnetic roller bias V4 is applied to the magnetic roller 3 so as to supply toner to the donor roller 1.

Figure 7:
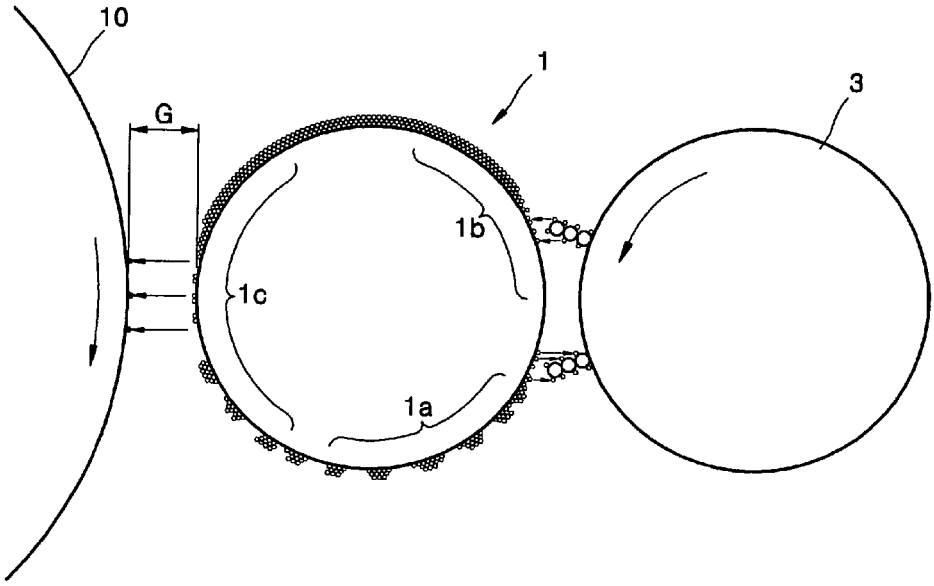
FIGS. 7 and 8 are diagrams illustrating development, toner recovery, and toner supply processes.
Figure 8:
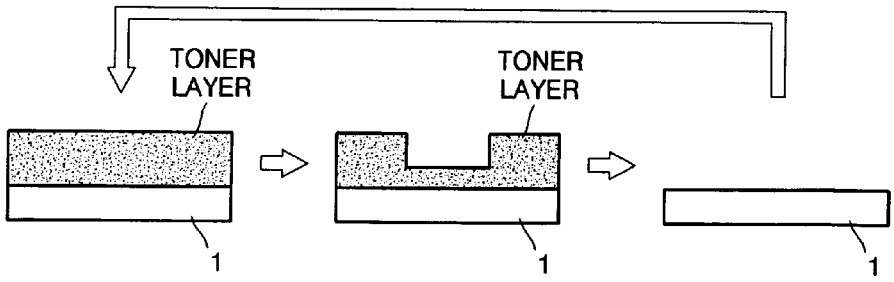

Development, toner supply, and toner recovery (removal) processes are shown in FIGS. 7 and 8. Due to the difference between the magnetic roller bias V4 and the supply bias V2, an electric field is produced, which supplies toner from the magnetic roller 3 to the downstream area 1*b* of the donor roller 1. Thus, a toner layer is formed on the circumference of the donor roller 1, as shown in FIG. 8. The development bias V3 produces an electric field to develop the toner from the development area 1*c* of the donor roller 1 to the image receptor 10. Thus, the toner attaches to an electrostatic latent image formed on the image receptor 10 by crossing the development gap G so as to develop the electrostatic latent image as a visible toner image. As shown in FIG. 8, after crossing the development gap G, toner which is not developed on the image receptor 10 remains on the surface of the donor roller 1. Due to the difference between the magnetic roller bias V3 and the recovery bias V1, an electric field is produced to remove the toner from the upstream area 1*a* of the donor roller 1. Thus, as shown in FIG. 8, toner which remains on the donor roller 1 and is not developed is separated from the donor roller 1 and then the area of the roller is returned to the developing device 6 or a magnetic brush of the magnetic roller 3. Thus, if toner is supplied again to the surface of the donor roller 1 in the downstream area 1*b*, a toner layer having uniform thickness is formed on the surface of the donor roller 1. As a result, it is possible to prevent a development ghost due to the toner layer supplied to the development area 1*c* having a non-uniform thickness.

In a conventional developing apparatus, a development bias V3 is applied to the whole circumference of a donor roller 1. The development bias V3 is applied to the donor roller 1 to develop toner from the donor roller 1 to an image receptor. Further, due to the difference between a magnetic roller bias V4 and the development bias V3, an electric field is produced to supply toner from a magnetic roller 3 to the donor roller 1. If an insufficient amount of the toner is supplied from the magnetic roller 3 to the donor roller 1, a toner layer formed on the surface of the donor roller 1 is non-uniform, and a development ghost is produced in which a latent image of an earlier development process remains in a subsequent development process. As the electric field applied to the downstream area 1*b* of the donor roller 1 has to be controlled in order to obtain sufficient toner supply, control of the development bias V3 causes development performance in the development area 1*c* to be changed. Furthermore, in order to form a toner layer having a uniform thickness on the donor roller 1, it is necessary to remove the toner remaining on the upstream area 1*a* of the donor roller 1. However, as an electric field for supplying toner from the magnetic roller 3 to the donor roller 1 acts on the entire donor roller 1, it is difficult to remove the toner from the donor roller 1.

With a developing method and apparatus according to embodiments of the present invention, it is possible to separately control the supply bias V2 and the development bias V3 for supplying an electric field to the downstream area 1*b*. Therefore, it is possible to control the supply bias V2 so as to supply sufficient toner to the donor roller 1 without interfering with development. In addition, the recovery bias V1 is applied to the upstream area 1*a* independently of the supply bias V2. Thus, it is possible to easily remove toner remaining on the donor roller 1 after development. Also, because the development bias V3 is controlled without affecting the characteristics of the toner supply from the magnetic roller 3 to the donor roller 1 and the characteristics of the toner recovery from the donor roller 1 to the magnetic roller 3, development performance can be improved.

For example, when toner is negatively charged, it is desirable that a potential Vs of the DC component of the supply bias V2 is higher than a potential Vm of the DC component of the magnetic roller bias V4. It is also desirable that a potential Vr of the DC component of the recovery bias V1 is lower than the potential Vm of the DC component of the magnetic roller bias V4. Compared to the conventional developing apparatus where the development bias V3 is applied to the whole donor roller 1, it is possible to more easily move toner from the magnetic roller 3 to the donor roller 1. Further, compared to the conventional developing apparatus where the development bias V3 is applied to the whole donor roller 1, toner is more easily moved from the donor roller 1 to the magnetic roller 3, such that toner can be simply removed from the donor roller 1. When the toner is positively charged, the relationship between the potentials Vs, Vr, and Vm of the DC components of the supply bias V2 and the recovery bias V1 and the DC component of the magnetic roller bias V4 is reversed relative to when the toner is negatively charged.

EMBODIMENT

An organic photo conductor is used as the image receptor 10, and the development gap G between the donor roller 1 and the image receptor 10 is set to about 250 μm. Toner in the developing device 6 is negatively charged. The electric potential (electric potential of non imaging part) of the image receptor 10 is set to −500V, and an electric potential (electric potential of imaging part) of an exposed part of the image receptor 10 is set to −100V. The magnetic roller bias V4 applied to the magnetic roller 3 is a DC bias of −300V. The development bias V3 applied to the third electrode 2*c* includes an AC bias with an amplitude of 1000V and a frequency of 1 KHz superposed on a DC bias of −300V. The supply bias V2 applied to the second electrode 2*b* includes an AC bias with an amplitude of 500V and a frequency of 2 KHz superposed on a DC bias of −200V. The recovery bias V1 applied to the first electrode 2*a* includes an AC bias with an amplitude of 500V and a frequency of 2 KHz superposed on a DC bias of −400V.

COMPARATIVE EXAMPLE

An organic photo conductor is used as an image receptor, and the development gap G between a donor roller and the image receptor is set to about 250 μm. Toner in a developing device 6 is negatively charged. An electric potential (electric potential of non imaging part) of the image receptor is set to −500V, and an electric potential (electric potential of imaging part) of an exposed part is set to −100V. The magnetic roller bias V4 applied to the magnetic roller 3 is a DC bias of −400V. The development bias V3 applied to the whole donor roller includes an AC with an amplitude of 1000V and a frequency of 1 KHz superposed on a DC bias of −300V.

In the comparative example, although toner is sufficiently supplied to the downstream area 1*b* and the amount developed in the development area 1*c* is sufficient, toner on the upstream area 1*a* of the donor roller 1 is not sufficiently removed. A toner layer which is formed on the donor roller 1 by continuously receiving toner from the magnetic roller 3 has a non-uniform thickness. Although an image printed under such a condition has satisfactory image density, when continuously printing, toner on the donor roller 1 is not sufficiently removed in the upstream area 2, and a development ghost occurs.

In the embodiment described above, toner supplied to the downstream area 1*b* is sufficient and the amount of toner developed from the development area 1*c* is also sufficient. Further, as the recovery bias V1 produces a sufficient electric field to remove toner from the downstream area 1*b* of the donor roller 1, toner recovery is excellent. Also, a toner layer which is formed on the donor roller 1 by continuously receiving toner from the magnetic roller 3 has uniform thickness. An image printed under such conditions has satisfactory image density, and when continuously printing, printing quality is stably kept without the occurrence of development ghosts.

As a modification to the above described embodiment, to remove toner from the donor roller 1 after development, the recovery bias V1 is controlled such that the electric potential between the upstream area 1*a* of the donor roller 1 and the magnetic roller 3 is 0V so as to decrease the adhesiveness of toner to the donor roller 1. The donor roller 1 and the magnetic roller 3 are rotated in the same direction, so that surfaces thereof in the upstream and downstream areas 1*a* and 1*b* rotate in opposite directions. The magnetic brush of the magnetic roller 3 contacts the donor roller 1 so as to remove toner from the surface of the donor roller 1.

While a developing apparatus and method for a single color are explained above, the developing apparatus and method of the present invention may be applied to a single-pass type color developing apparatus having a tandom structure or to a multi-pass type color developing apparatus where an image receptor is repeatedly developed and then sequentially transcribed to an interim transcript.

As described above, the hybrid type developing apparatus and method according to the present invention can obtain the following effects.

Since a supply bias and a recovery bias are applied to the circumference of a donor roller independent of a development bias, the performance of toner supply and recovery can be improved. In addition, because the supply bias and the recovery bias are independent of the development bias, it is possible to control the amount of toner supplied without affecting development performance and to easily remove toner from the donor roller after development. Therefore, high printing quality is realized without a development ghost during continuous printing.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A hybrid type developing method comprising:

forming a magnetic brush from a non-magnetic toner and a magnetic carrier on a circumference of a magnetic roller using a magnetic force;

forming a uniform toner layer on a circumference of a donor roller by providing only toner from the magnetic roller to the donor roller;

developing an electrostatic latent image formed on an image receptor with the toner on the donor roller;

dividing an area of the donor roller facing the magnetic roller into an upstream area and a downstream area with respect to a rotation direction of the donor roller as a reference direction;

applying an electric field to the upstream area of the donor roller to remove toner from the upstream area of the donor roller;

applying an electric field to the downstream area of the donor roller to supply toner from the magnetic roller to the downstream area of the donor roller;

applying an electric field to a development area of the donor roller facing the image receptor for developing the toner from the donor roller onto the image receptor, where the electric fields applied to the upstream area and the downstream area are independent from the electric field applied to the development area, the donor roller having a plurality of spaced apart electrodes on an outer surface thereof, a first brush electrode contacting at least one of the electrodes in the upstream area, a second brush electrode contacting at least one of the electrodes in the downstream area, and a third brush electrode contacting the electrodes in the development area, and applying a recovery bias to the first brush electrode to form an electric field for removing toner from the donor roller, applying a supply bias to the second brush electrode to form an electric field to supply toner to the donor roller;

applying a development bias to the third brush electrode to form an electric field for developing the toner; and wherein, if potentials of DC components of a magnetic roller bias applied to the magnetic roller, the recovery bias and the supply bias are denoted as $V_m$, $V_r$, and $V_s$, respectively, when the toner is negatively charged, $V_r<V_m<V_s$, and when the toner is positively charged, $V_s<V_m<V_r$.

2. The hybrid type developing method according to claim 1, wherein electric potentials of in the upstream area of the donor roller and the magnetic roller are equal to each other and the magnetic brush contacts the surface of the donor roller so as to remove the toner from the donor roller.

3. The hybrid developing method according to claim 1, further comprising:

controlling a thickness of the magnetic brush using a trimmer, wherein a gap between the trimmer and the magnetic roller ranges from 0.3 mm to 1.5 mm.

4. The hybrid type developing method according to claim 1, wherein a gap between the donor roller and the magnetic roller ranges from 0.3 mm to 1.5 mm.

5. The hybrid type developing method according to claim 1, wherein a gap between the donor roller and the image receptor ranges from 150 μm to 400 μm.

6. A hybrid type developing method comprising:

forming a magnetic brush from a non-magnetic toner and a magnetic carrier on a circumference of a magnetic roller using a magnetic force;

forming a uniform toner layer on a circumference of a donor roller by providing only toner from the magnetic roller to the donor roller;

developing an electrostatic latent image formed on an image receptor with the toner on the donor roller;

applying a developing bias to a developing area on the donor roller facing an image receptor in an upstream area with respect to the direction of rotation of the donor roller and developing toner from the donor roller to the image receptor, applying a toner recovery bias to a toner recovery area on the donor roller for removing toner from the donor roller, and applying a supply bias to a supply area of the donor roller in a downstream area with respect to the direction of rotation of the donor roller for supplying toner from the magnetic roller to the donor roller; and wherein, if potentials of the DC components of a magnetic roller bias applied to the magnetic roller, the recovery bias and the supply bias are denoted as $V_m$, $V_r$, and $V_s$, respectively, when the toner is negatively charged, $V_r<V_m<V_s$, and when the toner is positively charged, $V_s<V_m<V_r$.

7. The hybrid type developing method according to claim 6, wherein electric potentials of the toner recovery area of the donor roller.

8. The hybrid toner developing method according to claim 6, wherein the donor roller is spaced from the magnetic roller to define a gap.

9. The hybrid type developing method of claim 6, further comprising:

controlling a thickness of the magnetic brush using a trimmer, wherein a gap between the trimmer and the magnetic roller ranges from 0.3 mm to 1.5 mm.

10. The hybrid type developing method according to claim 6, wherein a gap between the donor roller and the magnetic roller ranges from 0.3 mm to 1.5 mm.

11. The hybrid type developing method according to claim 6, wherein a gap between the donor roller and the image receptor ranges from 150 μm to 400 μm.

* * * * *